United States Patent [19]

Walters

[11] Patent Number: 4,934,758

[45] Date of Patent: Jun. 19, 1990

[54] APPARTAUS FOR MOUNTING ANCILLARY EQUIPMENT

[75] Inventor: Colin R. Walters, Hyde, England

[73] Assignee: Dowty Mining Equipment Limited, Tewkesbury, England

[21] Appl. No.: 242,622

[22] Filed: Sep. 12, 1988

[30] Foreign Application Priority Data

Sep. 19, 1987 [GB] United Kingdom ..... 8722095

[51] Int. Cl.[5] ..... F21D 23/04

[52] U.S. Cl. ..... 299/43; 405/291

[58] Field of Search ..... 299/33, 43, 42; 405/291, 295, 296, 294; 91/170 MP

[56] References Cited

U.S. PATENT DOCUMENTS

| | | | |
|---|---|---|---|
| 4,187,042 | 2/1980 | Plevak et al. | 405/291 |
| 4,379,661 | 4/1983 | Wojaczek et al. | 405/291 X |
| 4,492,410 | 1/1985 | Schlusener et al. | 299/43 |
| 4,688,968 | 8/1987 | Fanget | 405/296 |

FOREIGN PATENT DOCUMENTS

| | | | |
|---|---|---|---|
| 2622886 | 11/1977 | Fed. Rep. of Germany | 299/43 |

*Primary Examiner*—Jerome W. Massie
*Assistant Examiner*—David J. Bagnell
*Attorney, Agent, or Firm*—Young & Thompson

[57] ABSTRACT

Apparatus for mounting ancillary equipment between two relatively movable members of, for example a mine roof support, comprises two substantially parallel arm members pivotally mounted between the two relatively movable members, two rotatable members secured one to each arm member, and at least one cross member pivotally mounted at opposing ends to the rotatable members. The members of the apparatus are arranged so that the axes of rotation of the rotatable members, the axis about which the arms pivot, and the axes about which the cross members pivot, are each transverse to the other two. This arrangement can be used to provide a mine roof support with an operating platform having mountings which have a degree of movement akin to a universal joint.

14 Claims, 3 Drawing Sheets

APPARTAUS FOR MOUNTING ANCILLARY EQUIPMENT

FIELD OF THE INVENTION

This invention relates to apparatus for mounting ancillary equipment between two relatively moveable members of, for example, a mine roof support.

The present invention is concerned with providing a stable operating platform for ancillary equipment mounted between two relatively moveable members, i.e. an operating platform from which the ancillary equipment can normally be operated without being affected by the position, or movement, of the two relatively moveable members.

SUMMARY OF THE INVENTION

In accordance with the present invention apparatus for mounting ancillary equipment between two relatively moveable members comprises:

two substantially parallel arm members which can be pivotally mounted to, and between, the two relatively moveable members;

two rotatable members disposed relative to a respective arm member; and at least one a cross member, pivotally mounted at opposing ends thereof to the rotatable members wherein (a) the axes of rotation of the rotatable members;

(b) the axis about which the arm members pivot; and (c) the axes about which the at least one cross members pivots;

are each transverse to the other two.

Preferably, the axes of rotation of the rotatable members, the axis about which the arm members pivot, and the axes about which the cross members pivot are each perpendicular to the other two. In this way, the axis of rotation of the rotatable member, the axis about which the arm member pivots, and the axis about which the cross member pivots, in respect of a particular arm member, each form one of the axis of a 3-dimensional geometric arrangement about which the arm may pivot.

This apparatus has primarily been developed for use in the mining industry however its uses are not strictly limited thereto. In particular, the apparatus is intended to enable an advancing ram of a mine roof support to be mounted between adjacent base pontoon members, or bases of, roof supports or chocks, in a support system, for example a longwall mining system.

Several particular types of bases and base arrangements have been developed for use with roof supports or chocks. The present apparatus is not restricted to use with any particular one of these bases or base arrangements. In fact, the apparatus may be mounted with respect to any type of base or base arrangement, for example platen type bases, pontoon style bases, single piece bases.

In previously proposed arrangements for the mounting advancing rams on roof support systems several operational problems have been encountered. These problems include:

the lack of accessibility to the area in the vicinity of the ram mounting in order to enable maintenance work to be carried out without adjustment of the support's hydraulic systems and/or interference with the miners' walkway;

the lack of adjustable movement of the supports ram system relative to the support possibly leading to interference, and impediment in the movement of the support, in particular with regard to debris/loose dirt, into which it has a tendency to dig in; and as a result of the ram having to be mounted on a member which is mounted between two relatively solid members in order to avoid the ram having dislocation problems, the adjustable movement, and accessibility to the ram for maintenance is further impeded/hindered.

Further, in supports/chocks which have two or more base members designed to allow relative movement between the base members of the base, the advancing ram normally has to be mounted on a suitable stable section of the roof support, which may be difficult to locate. This is necessary in order to prevent relative movement of the base members from interfering with the operation of the ram. This problem is particularly encountered, when the support/chock has been designed, so that advancing movement thereof is by means of a walking type motion induced between the base members.

The present invention greatly reduces the effect of the above mentioned problems and thereby goes a long way towards eliminating these problems.

The present invention carries the advantages that use of the apparatus provides:

an easily accessible ram mounting which enables maintenance work to be carried out without interfering with or impeding the miners walkway;

a ram mounting which enables the grading of the associated conveyor system to be easily adjusted;

a ram mounting which within certain confines enables the ram to ride on loose dirt/debris, and thereby prevents the ram from digging in; and a ram mounting which allows substantial relative movement between the base members without interfering with the operation of the ram.

When the apparatus is used in conjunction with an advancing ram of a roof support the apparatus may further include a hooking member which interconnects the ram and the conveyor belt bank of the conveyor system, in order to impart the necessary force thereto.

When the apparatus is used to provide a stable operating platform for an advancing ram, guide bars may be incorporated in order to assist the operation of the advancing ram and the grading of the conveyor. In this case the apparatus may also be provided with pads which act, in conjunction, with the guide bars to assist the operation of the advancing ram, and advance, of the roof support or the conveyor relative to the other and which pads act to prevent the guide bars from interfering with or impeding the miners walkway.

Stop members are, preferably, provided on the roof support or supports. These stop members are provided in order to prevent the apparatus from over pivoting about the pivotal connection of the arm members of the apparatus to the base member or members. The stop members are, preferably placed so as to prevent the apparatus being pivoted into a position in which the ram or apparatus interferes with the miners walkway or the hydraulic system of the roof support.

In order to assist the operation of the apparatus the pivotal and rotatable connections preferably comprise simple pin and hole arrangements. Preferably, the pins and holes are dimensioned so that the pin is loosely housed within the hole, thereby also allowing a degree of lateral freedom in the connection.

Further the connections are such that the apparatus, within the confines of the operation for which it has been designed, attains a freedom of movement akin to that of a universal joint.

The pins of the pin and hole arrangements may be formed as an integral part of one of the members in the respective connection. However, preferably the pin is a separate member which is housed within respective co-operating holes in the respective members forming the respective connection.

In either case the pin is provided with a head, or head members, which prevent the pin from passing through, or becoming dislodged from, the hole in the member, or members, of the respective connection.

Preferably the apparatus comprises at least two cross members.

Each of the rotatable members preferably comprises:

a flat platform section having a hole formed therein, by means of which the cross member or members are mounted thereto; and two pin members formed at opposing ends of the flat platform section, which pin members act as the pins for mounting of the rotatable members to the respective arm members.

Where the apparatus includes two cross members these may be mounted one above and one below the flat platform section of the rotatable members.

The pin members may be mounted in suitable hole arrangements in the arm members to provide the rotatable members with the ability to rotate.

The hole arrangements may be formed by suitable co-operating cut outs in the arm member and a co-operating plate member which can be secured thereto to secure the rotatable member in place.

The arm members are, preferably, formed with the pivotal connections to the base members and rotatable mountings at the longitudinally opposed ends thereof. The nature of this arrangement means that because of the lever principle, the greater the distance between the pivotal connection to the base members and the rotatable mountings the more efficient is the operation of the apparatus.

Preferably, the pivotal connections of the arm members to the base members are mutually exclusive to one another.

Preferably, the apparatus is mounted between adjacent pontoons of a roof support having a pontooned base. These maybe the pontoons of a single roof support or two adjacent roof supports.

Preferably, the apparatus is mounted between adjacent base members or bases in a support system.

Alternatively, the apparatus may be mounted on a single base member. In this case the apparatus can be mounted between two support brackets secured to the base member. Further, in this type of arrangement where the apparatus is mounted with respect to a single base or base member the degree of flexibility/movement present in the apparatus will not be utilised to the full therefore, the criteria for the design of the apparatus is not so exacting i.e. the length of the arm members, in particular the distance between the pivotal connection of the base member(s) to the arm members and the pivotal connection of the base member(s) to rotatable member can be reduced without undue effect to operation.

BRIEF DESCRIPTION OF THE DRAWINGS

The invention will now be described, by way of example, with reference to the accompanying drawings in which.

DETAILED DESCRIPTION OF PREFERRED EMBODIMENTS

Figure 1:
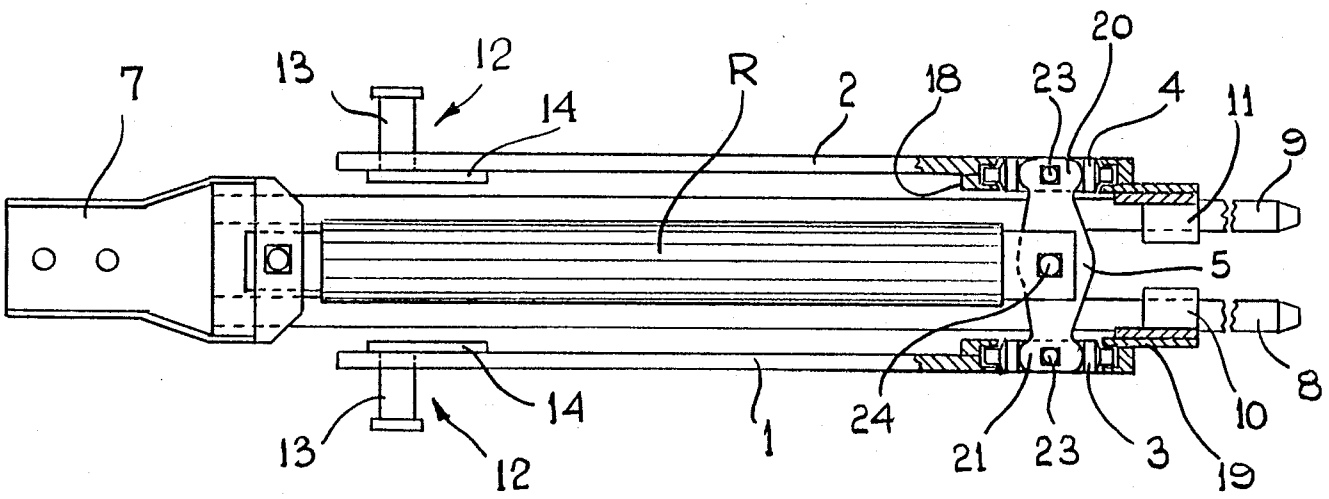
FIG. 1 is a plan view of the apparatus in accordance with the invention.
Figure 2:
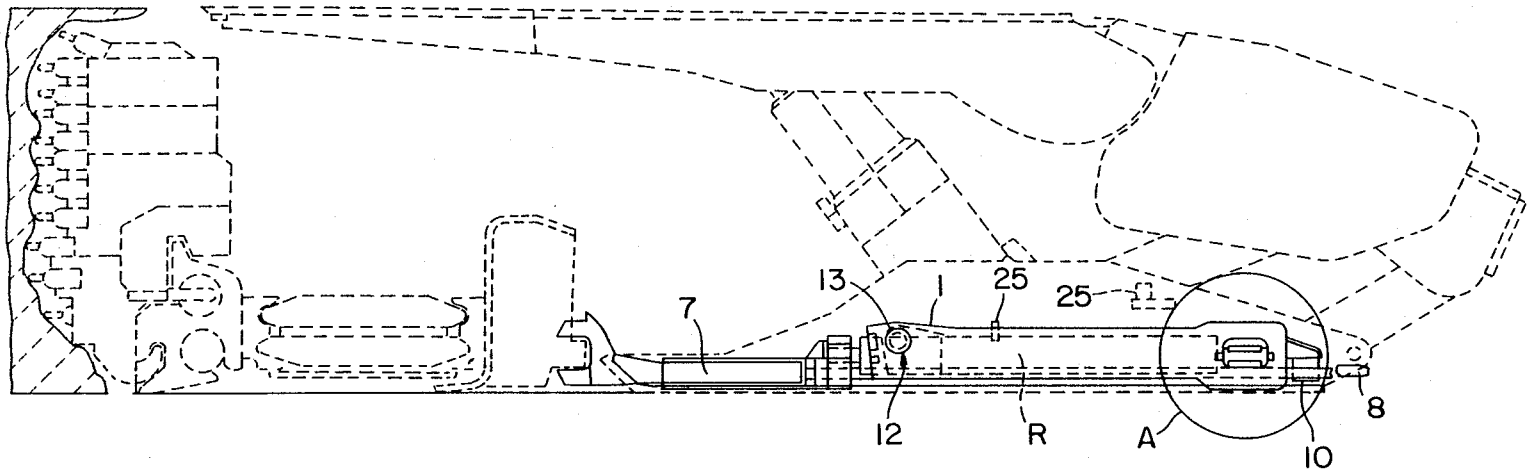
FIG. 2 is a side view of the apparatus shown in FIG. 1, shown applied to a mine roof support structure depicted in dashed lines.
Figure 3:
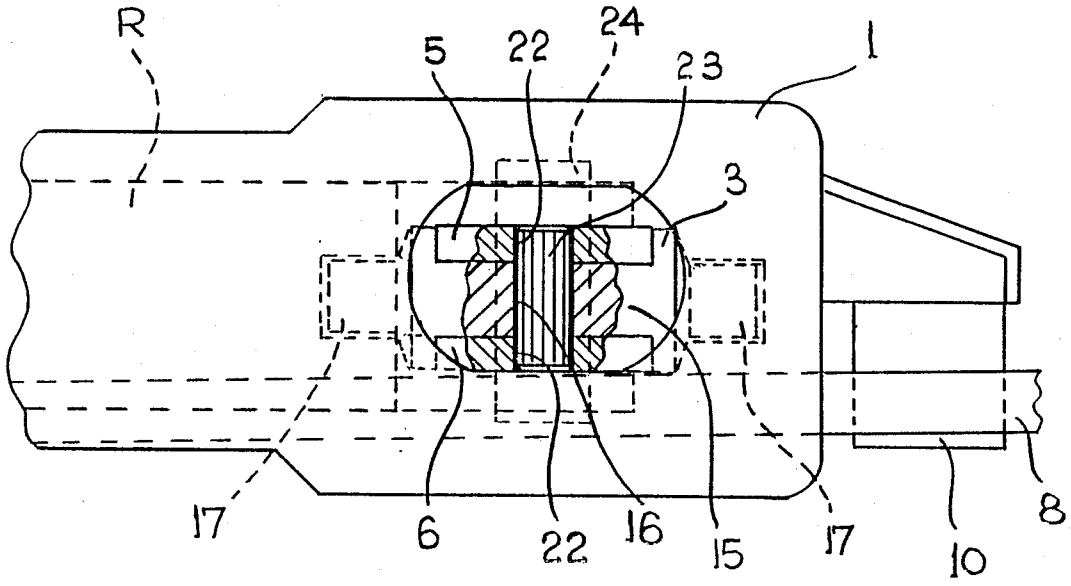
FIG. 3 is an enlarged view of A of FIG. 2.

Referring to the drawings, apparatus suitable for mounting an advancing ram R between two adjacent base members (not shown) of a roof support or roof supports (not shown) comprises:

two longitudinally extending arm members 1, 2;

two rotatable members 3, 4;

two cross members 5, 6;

a mounting hook 7, for interconnecting the advancing ram R and a conveyor system (not shown) in order to effect the transmission of the necessary force to move the roof support and conveyor relative to one another;

two guide bars 8, 9 extending rearwardly from the mounting hook 7, and which enable the conveyor to be graded;

two guide bar pads 10, 11 mounted on respective arm sections connected to the arm members 1, 2 so that they co-operate with a respective guide bar to prevent over pivoting thereof.

The longitudinally extending arm members 1, 2 are each pivotally connected to a respective base member of a roof support by means of a respective pivotal connection 12 at one end thereof.

Each of the connections 12 comprises a pin 13 which extends through a strengthening plate 14, secured to the respective arm members 1, 2, the respective arm member 1, 2 and into the base member. The pin 13 of this pivotal connection is suitably held in position so as to allow freedom of movement of the pivotal connection, and so that it does not impede the operation of the apparatus.

Each of the rotatable members 3, 4 comprises:

a flat mounting section 15 having a hole 16 extending therethrough;

two pin sections 17 at opposing ends thereof; and two bearing sections 18, one provided in association with each of the pin sections 17.

The rotatable members 3, 4 are each mounted in a respective arm member 1, 2 at the opposing end to the pivotal connection 12 thereof.

The rotatable members 3, 4 are mounted in recesses (not shown) formed in the respective arm member 1, 2 and a plate member 19, having a co-operating recess (not shown) is secured into place to secure the respective rotatable member in position. Further, whilst securing the rotatable members, this particular method of mounting the rotatable members provides the pivotal connection with a freedom of movement, particularly for the rotational movement of the rotatable member with respect to the arm member.

The two cross members 5, 6, are each formed as a plate like member and each is substantially identical to the other, having in plan view two dumbbell shaped end sections 20, 21. The shape of each of the end sections 20, 21 provides the cross member with strength in the region of the pivotal connection and a compact design whilst allowing for the high degree of freedom of movement required in the apparatus.

Each of the end sections 20, 21 is provided with a hole 22, which co-operates with the hole 16 in the respective rotatable member 3, 4 to provide a pivotal connection therebetween when a pin 23 is placed therethrough and secured in position.

The middle section of each of the cross members, 5, 6, is shaped to provide the cross member with the necessary strength to sustain the forces applied thereto and has a co-operating hole (not shown) extending therethrough to provide a pivotal connection point for mounting of the ancillary equipment.

The rearward end of the advancing ram is also provided with a mounting hole, so that when the ram is positioned on the apparatus a pin 24 may be placed through the mounting hole in the ram and the holes in the two cross members to effect the pivotal connection therebetween.

At its opposing end, the advancing ram R is connected to the mounting head 7.

The mounting head 7 is provided with two guide bars 8, 9 which extend therefrom substantially parallel to, and along the length of, the advancing ram 7 and underneath the cross member 6.

Two guide bar pads 10, 11 are mounted with respect to the apparatus at a point rearward of the rotatable members 3, 4 in order to prevent the guide bars of the arrangement from projecting upwardly, and causing a hazard to the miners.

The guide bars 8, 9 enable the conveyor, to which the mounting head 7 is connected, to be graded.

It should be noted that the pins 13, 23 and 24 are all loosely housed within their respective holes so as to provide the apparatus with a degree of lateral movement.

Further the apparatus is provided with a stop members 25, attached to the roof support and provided in order to prevent the apparatus from over pivoting about the pivotal connections 12 and becoming a hazard to miners working or walking in the walkway.

In operation the combination of the pivotal motion about the pins 13, 23, 24 provides the apparatus with a movement akin to that of a universal joint. This enables the apparatus to maintain the position of the advancing ram R with respect to the apparatus, and therefor the roof support, at the optimum centroid position.

I claim:

1. Apparatus for mounting ancillary equipment between two relatively movable adjacent roof support members, comprising:

two substantially parallel arm members adapted to be pivotally mounted to, and between, the two relatively movable members;

two rotatable members, one disposed on each of the two substantially parallel arm members; and a cross member, pivotally mounted at opposing ends thereof to the two rotatable members wherein the axes of rotation of the two rotatable members are transverse to the axis about which the arm members pivot, the axes about which the cross member pivots are transverse to the axes of rotation of the two rotatable members, and the axis about which the arm members pivot is transverse to the axes about which the cross member pivots.

2. Apparatus as claimed in claim 1, wherein the axes of rotation of the rotatable members, the axis about which the arm members pivot, and the axes about which the cross member pivots are all perpendicular to one another.

3. Apparatus as claimed in claim 1, wherein stop members are provided on the roof supports.

4. Apparatus as claimed in claim 3, wherein the stop members are placed so as to prevent the arm members being pivoted beyond a predetermined extent.

5. Apparatus as claimed in claim 1, wherein the rotatable members are disposed on the arm members and the cross member is mounted on the rotatable members by simple pin and hole arrangements.

6. Apparatus as claimed in claim 5, wherein the pins and holes are dimensioned so that the pin is loosely housed within the hole, thereby also allowing a degree of lateral freedom in the connection.

7. Apparatus as claimed in claim 5, wherein the pin is a separate member which is housed within respective co-operating holes in the respective members forming the respective connection.

8. Apparatus as claimed in claim 1, wherein the apparatus comprises at least two cross members.

9. Apparatus as claimed in claim 1, wherein each of the rotatable members comprises:

a flat platform section having a hole formed therein, by means of which the cross member is mounted thereto; and two pin members formed at opposing ends of the flat platform section, which pin members mount the rotatable members to the respective arm members.

10. Apparatus as claimed in claim 1, wherein each of the arm members is adapted for pivotal connection to a base member at one end, and receives a rotatable member at a longitudinally opposite end.

11. Apparatus as claimed in claim 10, wherein the arm members are adapted for independent pivotal connection to the base members.

12. Apparatus as claimed in claim 1, wherein the apparatus is adapted to be mounted between adjacent pontoons of a roof support having a pontooned base.

13. Apparatus as claimed in claim 1, wherein the apparatus is adapted to be mounted between adjacent base members or bases in a roof support system.

14. Apparatus as claimed in claim 1, wherein the apparatus is adapted to be mounted on a single base member.

* * * * *